US007988347B2

(12) United States Patent
Enenkel et al.

(10) Patent No.: US 7,988,347 B2
(45) Date of Patent: Aug. 2, 2011

(54) FASTENING SYSTEM AND LAMP HAVING A FASTENING SYSTEM

(75) Inventors: Martin Enenkel, Plauen (DE); Juergen Flechsig, Plauen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 248 days.

(21) Appl. No.: 12/377,693

(22) PCT Filed: Aug. 14, 2007

(86) PCT No.: PCT/IB2007/053221

§ 371 (c)(1),
(2), (4) Date: Feb. 17, 2009

(87) PCT Pub. No.: WO2008/020400

PCT Pub. Date: Feb. 21, 2008

(65) Prior Publication Data

US 2010/0194259 A1 Aug. 5, 2010

(30) Foreign Application Priority Data

Aug. 18, 2006 (EP) ..... 06119187

(51) Int. Cl.
*H01R 33/72* (2006.01)

(52) U.S. Cl. ..... 362/647; 362/487

(58) Field of Classification Search ..... 362/487, 362/647, 649, 651

See application file for complete search history.

(56) References Cited

U.S. PATENT DOCUMENTS

| | | | | |
|---|---|---|---|---|
| 6,976,776 | B2 * | 12/2005 | Kakidaira et al. | 362/649 |
| 6,981,793 | B2 | 1/2006 | Behr et al. | |
| 7,264,391 | B2 * | 9/2007 | Kaandorp | 362/649 |
| 2005/0002187 | A1 | 1/2005 | Behr et al. | |

FOREIGN PATENT DOCUMENTS

| | | | |
|---|---|---|---|
| DE | 10146475 | A1 | 4/2003 |
| EP | 0274262 | B1 | 7/1988 |
| EP | 1455134 | A1 | 9/2004 |
| FR | 2888797 | A1 | 1/2007 |
| WO | 03056237 | A1 | 7/2003 |
| WO | 2004044488 | A1 | 5/2004 |

* cited by examiner

*Primary Examiner* — David V Bruce

(57) ABSTRACT

A fastening system for fastening a lamp has at least one electrical source of radiant light, in place in a light system. Part of the lamp projects into an opening in the light system and is releasably connected thereto. At least three lugs take the form of electrical contacts and reference points in this case, and the areas of contact of the lug and lug-receptacle system are so arranged that, in the end position, their mating areas can be caused to mate in positive inter-engagement by an axially applied force.

20 Claims, 2 Drawing Sheets

FASTENING SYSTEM AND LAMP HAVING A FASTENING SYSTEM

The invention relates to a fastening system for fastening a lamp, having at least one electrical source of radiant light, in place in a light system, part of the lamp projecting into an opening in the light system and being releasably connected thereto.

Fastening systems of this kind are used for example in light systems belonging to a motor vehicle lighting system, where what are termed bayonet connections are widely used, particularly for certain types of lamp.

A fastening system of this kind, particularly for a motor vehicle lighting system, is known from WO 2004/044488 A1. This fastening system is used for fastening a lamp in place in a reflector housing by means of a bayonet connection, part of the lamp projecting into an opening in the reflector housing. This part of the lamp has a spring system having a first spring member that, for fastening in place radially relative to the longitudinal axis of the lamp, presses against the surface of the inner wall of the said opening. This spring member also acts as an electrical contact that corresponds to a further electrical contact, which is arranged on the surface of the inner wall of the said opening.

The lamp also comprises a rubber sealing ring, which is intended to make a watertight seal with the rear wall of the opening.

This fastening system is not sufficiently secure and reliable in design for all applications.

The radial force is applied by the spring member itself, meaning that if the spring suffers the usual fatigue or if it fractures, when for example it has been in use for a long time and is subject to constant vibration or shaking during driving, there is no guarantee of a constant applied pressure. There is thus no guarantee of secure and reliable electrical contact being made and adequate safety in traffic therefore does not exist or exists to only a limited degree. Also, the maximum spring-applied force and the maximum area of contact that exist in any given case are limited by the way in which the system operates. The solution described is one in which the connection is made essentially by force and in which the connection, as far as the maintaining of a set position is concerned, is stable to only a limited degree in relation to forces applied transversely to the force applied by the spring itself, due for example to slippage at the sealing ring. Electrical contact is thus possible even away from a desired, stable end position.

A radial application of force is generally a problem with lamps of this kind, which have a V-type referencing or locating system for this purpose, because an application of force of this kind has an adverse effect on the said V-type referencing or locating system.

It is an object of the invention to provide a more reliable yet easily operated solution for a fastening system and to provide a lamp having such a fastening system. In particular, the V-type referencing system is not to be affected in this case and it is to be made possible for there to be a larger area of contact. Also, safety in traffic is to be increased for use in a light system of a motor vehicle lighting system. The lamp is to be capable of being produced effectively and efficiently in the context of industrial mass production.

What is essential to the invention in this case is that, in the fastening system for fastening a lamp, having at least one electrical source of radiant light, in place in a light system, part of the lamp projecting into an opening in the light system and the said part of the lamp being releasably connected by a lug and lug-receptacle system that comprises at least three lugs and three corresponding lug-receptacles, the lugs take the form of electrical contacts and reference points, and the areas of contact of the lug and lug-receptacle system are so arranged that, in the end position, their mating areas are caused to mate in positive interengagement by an axially applied force.

The releasable connection that is obtained is primarily a positively interengaged connection, there also being, secondarily, a connection made by force as a result of the axial restoring force. This combination allows there to be large contact areas, i.e. very good electrical contact and improved characteristics with regard to application by pressure. The making of electrical contact is only possible when there is positive interengagement, i.e. in the end position, and the possibility of electrical contact being made before this end position is reached, i.e. being made in an unstable state of contact that may vary as a result for example of vibration or shaking of the vehicle, is reliably ruled out. The positive interengagement makes slipping out of the end position impossible, or at least very much more difficult, in any direction, the axially applied force also making this more difficult.

The axial application of force takes place either via the entire applied area of the sealing ring, which is substantially larger than in the case where contact is made by virtue of the force applied by a spring, or via a plurality of pressing areas on a resilient clamping ring.

The requirements that are set for the accurate sizing or constancy of this axial force are not very stringent, thus enabling a very high efficiency to be achieved by means that are relatively simple technically.

In the context of industrial mass production, this solution can be implemented inexpensively and can be matched to the particular standard of the product.

What may be mentioned as types of lamp for motor vehicle lighting systems for which the solution according to the invention is particularly suitable are for example so-called HB 5, H9 and H13 lamps.

It is preferable for the axially applied force to be the self-restoring force from a sealing ring. This solution is particularly suitable for applications that call for a watertight enclosure.

As an alternative, it is preferable for the axially applied force to be the self-restoring force from a resilient clamping ring. This gives a solution that is appropriate for applications where a sealed construction is not needed.

What is essential to the invention in this case is for the fastening elements of the bayonet connection of the lamp to have at least three lugs whose mating areas can be applied, by an axially applied force, to mate in positive interengagement with the mating areas of other fastening elements of the bayonet connection that are not arranged on the lamp, and for at least three lugs to take the form of electrical contacts and reference points.

It is preferable for the axially applied force for the positively interengaged mating to be the self-restoring force from a sealing ring.

These and other aspects of the invention are apparent from and will be elucidated with reference to the embodiments described hereinafter.

Figure 1:
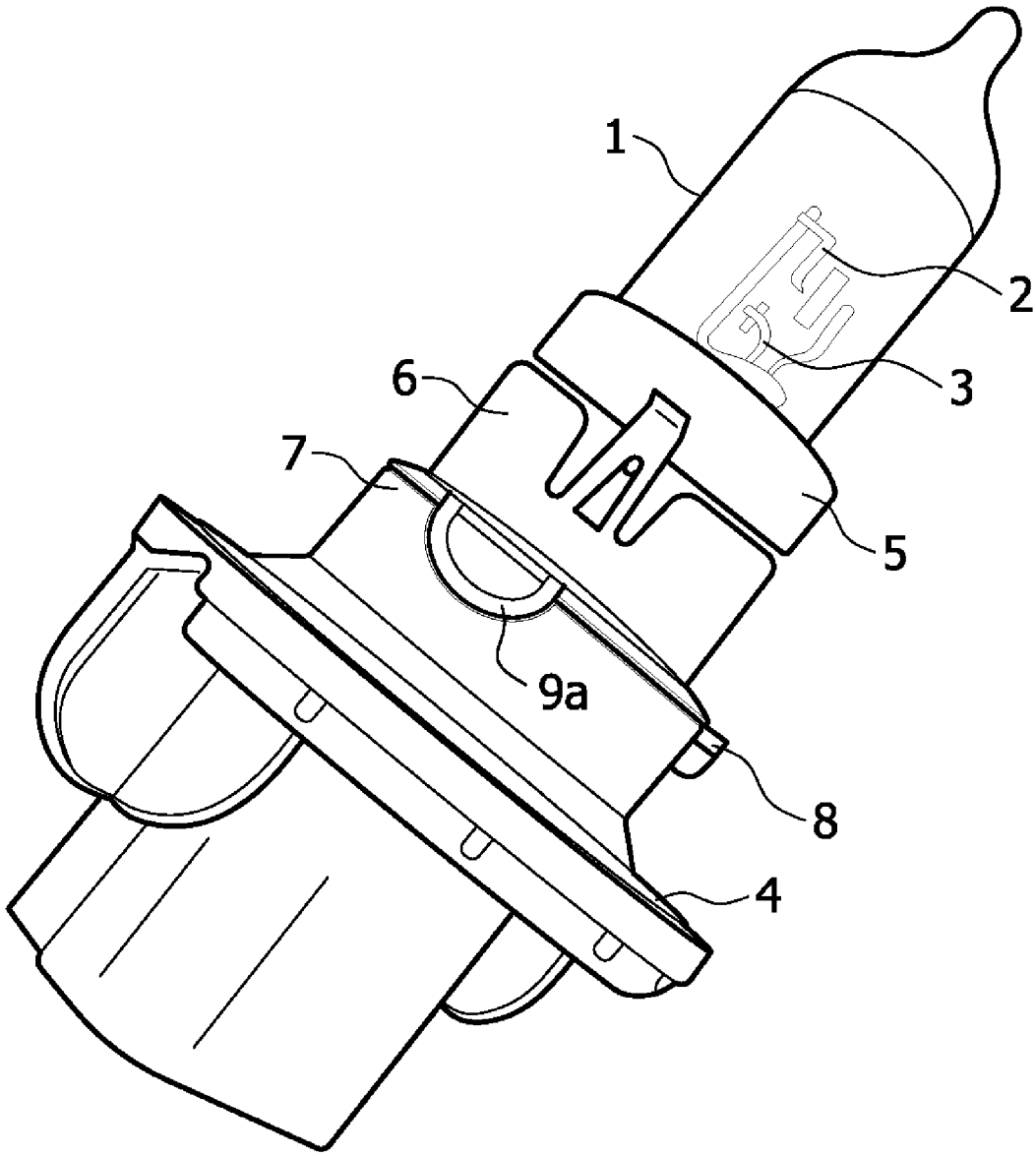
FIG. 1 is a schematic view from the side of a lamp according to the invention for a motor vehicle headlamp.

The preferred embodiment of the invention that is shown in FIG. 1 is a twin-filament halogen incandescent lamp that is intended for use in a motor vehicle headlamp.

The lamp has a substantially cylindrical, glass lamp envelope 1 having two incandescent coils 2, 3 that are arranged approximately parallel to the longitudinal axis of the lamp in the usual way. Three current supply means (not shown in FIG. 1), which project out of the end of the lamp envelope 1 that is situated adjacent the cap, are used to support the two incandescent coils 2, 3 and to supply current to them. The end of the lamp envelope 1 that is situated adjacent the cap is anchored in an opening in a metal mounting 5, which is part of the cap of the lamp, by a normal clamped fit. The metal mounting 5 is fixed to the metal adjusting ring 6 that is welded to the reference ring 7. The reference ring 7 has three reference lugs (not shown in FIG. 1) that extend outwards radially substantially perpendicularly to the longitudinal axis and that are situated in a single plane. The reference lugs are arranged around the circumference of the reference ring 7 at intervals of 120°. By means of the usual adjusting processes, the two incandescent coils 2, 3 are exactly aligned relative to the three reference lugs and the reference plane defined by them when the parts 5, 6, and 7 of the metal cap are being welded together, thus also enabling the position of the incandescent coils 2, 3 in the reflector of a headlamp to be clearly fixed by the orientation and installed position of the three reference lugs within the reflector when the lamp is fitted into a headlamp.

The reference ring 7 is fastened to the top, approximately cylindrical, part of the metal flange 8 of the cap. This top part of the flange 8 of the cap merges into the center part of the flange 8 of the cap, this latter part having a face that is symmetrical in rotation and that is arranged perpendicularly to the longitudinal axis of the lamp and that faces towards the end of the lamp envelope 1 that is remote from the cap. Inserted in this face, projecting approximately uniformly therefrom, and fastened in position in a groove extending round in a circle, is an elastic sealing ring 4.

When a force directed parallel to the longitudinal axis of the lamp is applied to the sealing ring, the sealing ring 4 is so designed as to be able still to project above the face that surrounds it of the center part of the flange 8 of the cap, which face is symmetrical in rotation. Amongst other things, this ensures that a secure and reliable seal is obtained in the end position as a result of a corresponding axial self-restoring force.

Following on from the center part of the flange 8 of the cap is the bottom part of the flange 8 of the cap, which is constructed in the usual way, for example as standardized by the IEC rules for P26.4t lamp caps.

The top part of the flange 8 of the cap has three lugs 9*a*, 9*b*, 9*c* that extend radially outwards substantially perpendicularly to the longitudinal axis. The lugs 9*a*, 9*b* and 9*c* are arranged around the circumference of the top part of the flange 8 of the cap at intervals of 120°. The lug 9*a* is formed to be wider than the other two lugs 9*b* and 9*c*, in order to define an orientation for the lamp in the headlamp, i.e. its installed position in the headlamp. The three lugs 9*a*, 9*b* and 9*c* take the form of reference points and electrical contacts, electrical contact with the three power supply means being made in the usual way.

The contact areas of the lugs 9*a*, 9*b* and 9*c* are so arranged and so correspond to one another, or rather to the contact areas of the three lug-receptacles belonging to the lug and lug-receptacle system, that, in the end position, the total of six mating areas that the said system has are caused to mate substantially in positive interengagement by an axially applied force.

In the embodiment, the lugs 9*a*, 9*b* and 9*c* are each of an approximately semi-circular outline shape that converges towards the bottom part of the flange 8 of the cap. The lug-receptacles (shown in FIG. 2) are of an outline shape that corresponds to this, thus enabling at least parts of the areas to mate with one another in positive interengagement in the end position. The positive interengagement is achieved by means of an axial opposing force that, in the end position, corresponds to the self-restoring force from the elastic sealing ring.

To connect the lamp, having at least one source of radiant light, of a light system, of for example a motor vehicle lighting system, to another part of this light system, such for example as the reflector housing of the lamp, the lamp is inserted in the direction of its longitudinal axis into an opening in the light system and is fastened in place in the said opening by being turned radially. The lugs 9*a*, 9*b* and 9*c* of the lamp and the corresponding lug-receptacles of the receptacle for the lamp cap thus form a bayonet connection.

Figure 2:
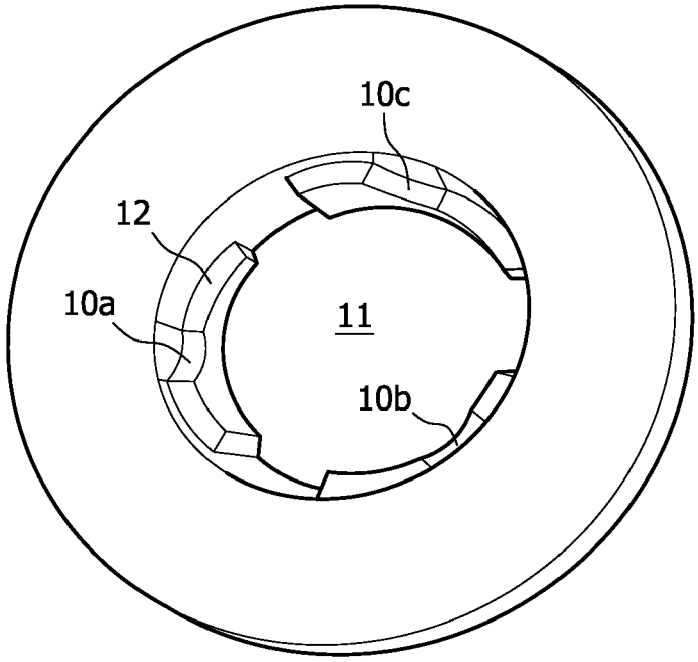
FIG. 2 is a schematic view of part (the lug receptacle of the lug and lug-receptacle system) of a fastening system according to the invention for fastening in place a lamp.

Shown in FIG. 2 is a schematic view of part (the lug receptacle of the lug and lug-receptacle system) of a fastening system according to the invention for fastening a lamp in place.

The contact areas of the lug-receptacles 10*a*, 10*b* and 10*c* are so arranged in the opening 11 of a light system, such as a reflector housing for example, and so correspond to the contact areas of the three lugs 9*a*, 9*b* and 9*a* (not shown in FIG. 2) of the lug and lug-receptacle system that, in the end position, the total of six mating areas that the system has are caused to mate substantially in positive interengagement by an axially applied force.

In the embodiment, the lugs 9*a*, 9*b* and 9*c* are each of an approximately semi-circular outline shape that converges towards the bottom part of the flange 8 of the cap. The lug-receptacles 10*a*, 10*b* and 10*c* are of an outline shape that corresponds to this, thus enabling at least parts of the areas to mate with one another in positive interengagement in the end position. To improve the making of the positive interengaged connection, the three lug-receptacles 10*a*, 10*b* and 10*c* have auxiliary elements 12 of a ramp-like form.

Figure 3:
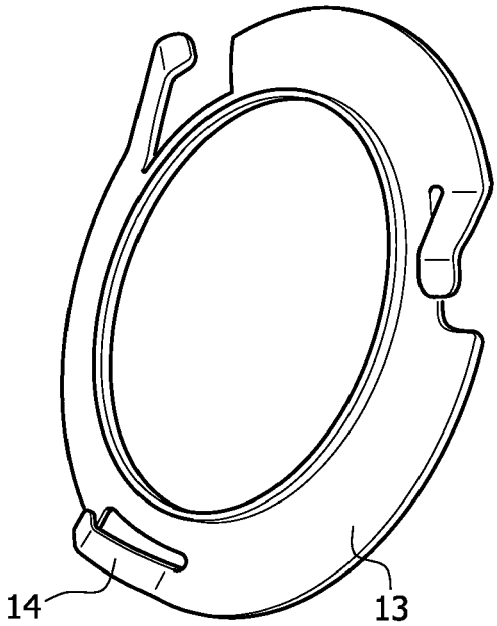
FIG. 3 is a schematic view from the side of a resilient clamping ring.

FIG. 3 is a schematic view from the side of a resilient clamping ring 13. The resilient clamping ring 13 has a disc-shaped main body and three resilient fingers 14 that project by equal amounts from the plane of the resilient clamping ring 13 and that each have a pressing face. The resilient clamping ring 13 is made of a standard resiliently elastic material such for example as spring steel. The resilient clamping ring 13 may be arranged on the center part of the flange 8 of the cap as an alternative to the sealing ring, thus enabling the axial self-restoring forces from the resilient fingers 14 to cause the mating areas of the fastening members to mate with one other in positive interengagement via the pressing faces.

The invention claimed is:

1. A fastening system for fastening a lamp, having at least one electrical source of radiant light, in place in a light system, part of the lamp projecting into an opening in the light system and the said part of the lamp being releasably connected by a lug and lug-receptacle system that comprises at least three lugs and three corresponding lug-receptacles, wherein at least three lugs take the form of electrical contacts and reference points, and the areas of contact of the lug and lug-receptacle system are so arranged that, in the end position, their mating areas can be caused to mate in positive interengagement by an axially applied force substantially parallel to a longitudinal axis of the lamp, and wherein the axially applied force is a self-restoring force from a sealing ring or from a resilient clamping ring.

2. The fastening system of claim 1, wherein one of the at least three lugs is wider than remaining of the at least three lugs.

3. The fastening system of claim 1, wherein the at least three lugs extend from a top part of a flange attached to a cap of the lamp, the at least three lugs extending in a radially outwards direction which is substantially perpendicularly to the longitudinal axis of the lamp.

4. The fastening system of claim 3, wherein the at least three lugs have a substantially semi-circular outline shape that converges towards a bottom part of the flange.

5. The fastening system of claim 1, wherein the at least three lugs have a substantially semi-circular outline shape that converges towards a bottom part of a flange of a cap of the lamp.

6. The fastening system of claim 5, wherein the three corresponding lug-receptacles include first portions having the substantially semi-circular outline shape, and second portions having auxiliary elements of a ramp-like form that extend from the first portions.

7. A lamp for a light system, comprising at least a lamp envelope in which at least one electrical source of radiant light is enclosed and from which at least two current supply means project, a lamp cap that has at least one sealing ring and one cap part to which the lamp envelope is fastened at the lamp cap, and fastening elements belonging to a lug and lug-receptacle system, wherein the fastening elements of the lug and lug-receptacle system of the lamp comprise at least three lugs whose mating areas can be applied, by an axially applied force which is substantially parallel to a longitudinal axis of the lamp, to mate in positive interengagement with the mating areas of other fastening elements of the lug and lug-receptacle system that are not arranged on the lamp, and wherein at least three of these lugs are in the form of electrical contacts and reference points, and wherein the axially applied force is a self-restoring force from a sealing ring or from a resilient clamping ring.

8. The lamp as claimed in claim 7, wherein the lug and lug-receptacle system has three lugs and three corresponding lug-receptacles.

9. The lamp of claim 7, wherein one of the at least three lugs is wider than remaining of the at least three lugs.

10. The lamp of claim 7, wherein the at least three lugs extend from a top part of a flange attached to a cap of the lamp, the at least three lugs extending in a radially outwards direction which is substantially perpendicularly to the longitudinal axis of the lamp.

11. The lamp of claim 10, wherein the at least three lugs have a substantially semi-circular outline shape that converges towards a bottom part of the flange.

12. The lamp of claim 7, wherein the at least three lugs have a substantially semi-circular outline shape that converges towards a bottom part of a flange of a cap of the lamp.

13. The lamp of claim 12, wherein the three corresponding lug-receptacles include first portions having the substantially semi-circular outline shape, and second portions having auxiliary elements of a ramp-like form that extend from the first portions.

14. A lamp for a light system, comprising:

a lamp envelope in which at least one electrical source of radiant light is enclosed;

a lamp cap attached to the lamp envelope and having a flange comprising at least three lugs having lug mating areas;

a reference ring comprising receptacle mating areas; and a sealing ring located at an end the reference ring remote from the lamp cap;

wherein the lug mating areas mate with the receptacle mating areas in positive interengagement by an axially applied force substantially parallel to a longitudinal axis of the lamp, and wherein the axially applied force is a self-restoring force from the sealing ring.

15. The lamp of claim 14, wherein the sealing ring is located in a groove of the end of the reference ring remote from the lamp cap 16. The lamp of claim 14, wherein one of the at least three lugs is wider than remaining of the at least three lugs.

17. The lamp of claim 14, wherein the at least three lugs extend from a top part of the flange, the at least three lugs extending in a radially outwards direction which is substantially perpendicularly to the longitudinal axis of the lamp.

18. The lamp of claim 14, wherein the at least three lugs have a substantially semi-circular outline shape that converges towards a bottom part of the flange.

19. The lamp of claim 18, wherein the three corresponding lug-receptacles include first portions having the substantially semi-circular outline shape, and second portions having auxiliary elements of a ramp-like form that extend from the first portions.

20. The lamp of claim 14, wherein at least one lug of the at least three lugs is in a form of an electrical contact and a reference point.

* * * * *